US012522943B2

(12) United States Patent
Kuo et al.

(10) Patent No.: US 12,522,943 B2
(45) Date of Patent: Jan. 13, 2026

(54) SYSTEM AND METHOD FOR ELECTROFORMING A COMPONENT

(71) Applicant: Unison Industries, LLC, Jacksonville, FL (US)

(72) Inventors: Pei-hsin Kuo, Alplaus, NY (US); Edward James Nieters, Burnt Hills, NY (US)

(73) Assignee: Unison Industries, LLC, Jacksonville, FL (US)

( * ) Notice: Subject to any disclaimer, the term of this patent is extended or adjusted under 35 U.S.C. 154(b) by 453 days.

(21) Appl. No.: 17/991,349

(22) Filed: Nov. 21, 2022

(65) Prior Publication Data

US 2024/0167187 A1 May 23, 2024

(51) Int. Cl.
*C25D 21/12* (2006.01)
*C25D 1/00* (2006.01)

(52) U.S. Cl.
CPC ..... *C25D 21/12* (2013.01); *C25D 1/00* (2013.01)

(58) Field of Classification Search
CPC ..... C25D 1/00–10
See application file for complete search history.

(56) References Cited

U.S. PATENT DOCUMENTS

| | | | | |
|---|---|---|---|---|
| 3,763,030 | A | 10/1973 | Zimmer | |
| 4,108,740 | A | 8/1978 | Wearmouth | |
| 4,158,073 | A | 6/1979 | Schneider et al. | |
| 6,665,078 | B1 | 12/2003 | Meeks et al. | |
| 6,732,579 | B2 | 5/2004 | Keith et al. | |
| 7,784,346 | B2 | 8/2010 | Williams et al. | |
| 11,061,382 | B2 | 7/2021 | Detor | |
| 2019/0186033 | A1 | 6/2019 | Ruan et al. | |
| 2019/0360116 | A1* | 11/2019 | Collinson | G01N 27/42 |
| 2020/0192328 | A1* | 6/2020 | Detor | C25D 21/12 |
| 2023/0131625 | A1* | 4/2023 | Dekker | G01N 29/2487 73/661 |
| 2023/0340684 | A1* | 10/2023 | Chang | C25D 1/003 |

FOREIGN PATENT DOCUMENTS

| | | | |
|---|---|---|---|
| JP | S55145190 | A | 11/1980 |
| JP | H03211296 | A | 9/1991 |
| WO | 2015073068 | A2 | 5/2015 |
| WO | 2019242034 | A1 | 12/2019 |

OTHER PUBLICATIONS

Kimura et al., Original & Machine Translation, JP H03-211296 A (Year: 1991).*
Chen, Original & Machine Translation, CN 109082690 A (Year: 2018).*
Yu, Original & Machine Translation, CN 114836813 A (Year: 2022).*
Wang et al., CN 110184641 A (Year: 2019).*
Search report from corresponding appliation GB2316197.0 Dec. 11, 2023.

* cited by examiner

*Primary Examiner* — Hosung Chung
(74) *Attorney, Agent, or Firm* — McGarry Bair PC

(57) ABSTRACT

A system and method of inspecting a thickness of metal on an electroformed component. The system capable of scanning the electroformed component with a sensor. The system including a computer for generating a scan data set indicative of the thickness of the metal on the electroformed component. A controller for instructing an anode to deposit additional metal on the electroformed component where the thickness is less than a target thickness.

12 Claims, 13 Drawing Sheets

SYSTEM AND METHOD FOR ELECTROFORMING A COMPONENT

TECHNICAL FIELD

The present subject matter relates generally to a system and method for electroforming a component.

BACKGROUND

An electroforming process can create, generate, or otherwise form a metallic layer of a desired component. In one example, a mold or base for the desired component can be submerged in an electrolytic liquid and electrically charged. The electric charge of the mold can attract an oppositely-charged electroforming material through the electrolytic solution. The electrical attraction of the electroforming material to the mold ultimately deposits the electroforming material onto exposed surfaces of the mold, creating an external metallic layer.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
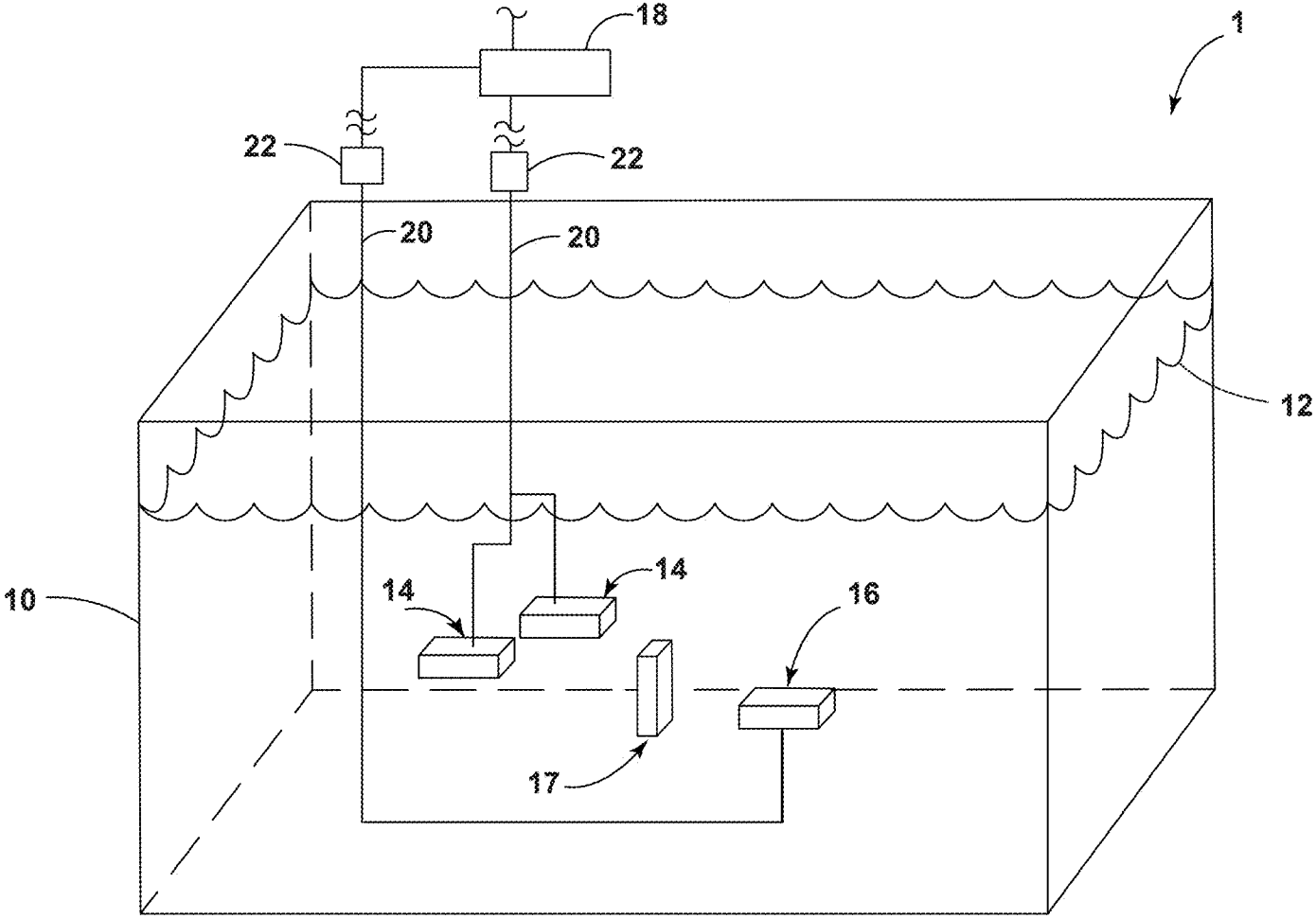
FIG. 1 (Prior Art)
FIG. 1 is a schematic perspective view of a prior art electroforming system for forming a component.

Aspects of the present disclosure are directed to a system and method for inspecting an electroformed component. More specifically, the system and method enable inspection of the electroformed component, during fabrication or deposition, in real-time. It will be understood that the disclosure can have general applicability in a variety of applications, including that the inspection of the electroformed component can be utilized for components in any suitable mobile and non-mobile industrial, commercial, and residential applications.

Electroforming is an additive manufacturing process where metal parts are formed through electrolytic reduction of metal ions on the surface of a mandrel or cathode. In a typical electroforming process, a mandrel (cathode) and an anode are immersed in an electrolyte solution. A metal layer forming a part thickness builds up on the mandrel surface over time as current is passed between the electrodes. Once the desired part thickness is reached, the mandrel can be removed by mechanical, chemical, or thermal treatment, yielding a free-standing metal part. In one example, the mandrel can be a low melting point material (also referred to as a "fusible alloy") which can be cast into the mandrel shape and subsequently melted out for re-use following electroforming. Other mandrel options include conductive waxes and metallized plastic which can be formed by injection molding, additive manufacturing, or the like. In some cases, a reusable mandrel can also be utilized.

Electroforming is used to manufacture products across a range of industries including healthcare, electronics, and aerospace. Electroforming manufacturing processes offer several advantages, including that such processes are efficient, precise, scalable, and low-cost. However, challenges due to limited material options may limit broader application of this technology for advanced structural components. Accordingly, there remains a need for improved methods of manufacturing electroformed components, particularly high-performance structural components.

As used herein, "electrodeposition" will include any process for building, forming, growing, or otherwise creating a metal layer over another substrate or base. Non-limiting examples of electrodeposition can include electroforming, electroless forming, electroplating, or a combination thereof. While an electroforming process is generally described herein, it will be understood that aspects of the disclosure are applicable to any and all electrodeposition processes.

As used herein, "non-sacrificial anode" will refer to an inert or insoluble anode that does not dissolve in electrolytic solution when supplied with current from a power source, while "sacrificial anode" will refer to an active or soluble anode that can dissolve in electrolytic solution when supplied with current from a power source. Non-limiting examples of non-sacrificial anode materials can include titanium, gold, silver, platinum, and rhodium. Non-limiting examples of sacrificial anode materials can include nickel, cobalt, copper, iron, tungsten, zinc, and lead. It will be understood that various alloys of the metals listed above may be utilized as sacrificial or non-sacrificial anodes.

All directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. In addition, as used herein "a set" can include any number of the respectively described elements, including only one element.

The exemplary drawings are for purposes of illustration only and the dimensions, positions, order, and relative sizes reflected in the drawings attached hereto can vary.

FIG. 1 is a schematic illustration of a prior art electroforming system 1. A prior art electrodeposition tank 10 (or "tank 10") can carry a single metal constituent fluid or electrolytic solution 12 having alloying metal ions. At least one electrode can be provided in the tank 10. The at least one electrode can include multiple anodes 14 and a cathode 16. A mandrel for a component to be electroformed can define the cathode 16. A stationary shield 17 can be provided within the tank in order to control electrodeposition on the cathode 16.

A power source 18, which can include a controller or controller module, can electrically couple to the anode 14 and the cathode 16 by electrical conduits 20 to form a circuit via the conductive electrolytic solution 12. Optionally, a switch 22 or sub-controller can be included along the electrical conduits 20 between the power source 18, anode 14, and cathode 16. During operation, a current can be supplied from the anode 14 to the cathode 16 to electroform a body at the cathode 16. Supply of the current can cause metal ions from the electrolytic solution 12 to form a metallic layer over the cathode 16 to form the component.

Electroforming material options have typically included nickel, copper, or a nickel-cobalt alloy. Such materials have traditionally allowed for a suitably high deposition rate (e.g., greater than 0.001 in/hr or 0.025 mm/hr), high current efficiency (e.g., the proportion of current used to convert metal ions to solid metal, instead of other side reactions), and low residual stresses in the finished component. Such material options for structural applications are typically limited to maximum usage temperatures of approximately 500° F. (260° C.), with strength and temperature capability limited to approximately 100 ksi (690 MPa) ultimate tensile strength at 500° F. (260° C.). In addition, electrodeposition of high-strength multi-component alloys can present challenges for incorporation of all of the various alloying elements in the electrolyte bath.

Figure 2:
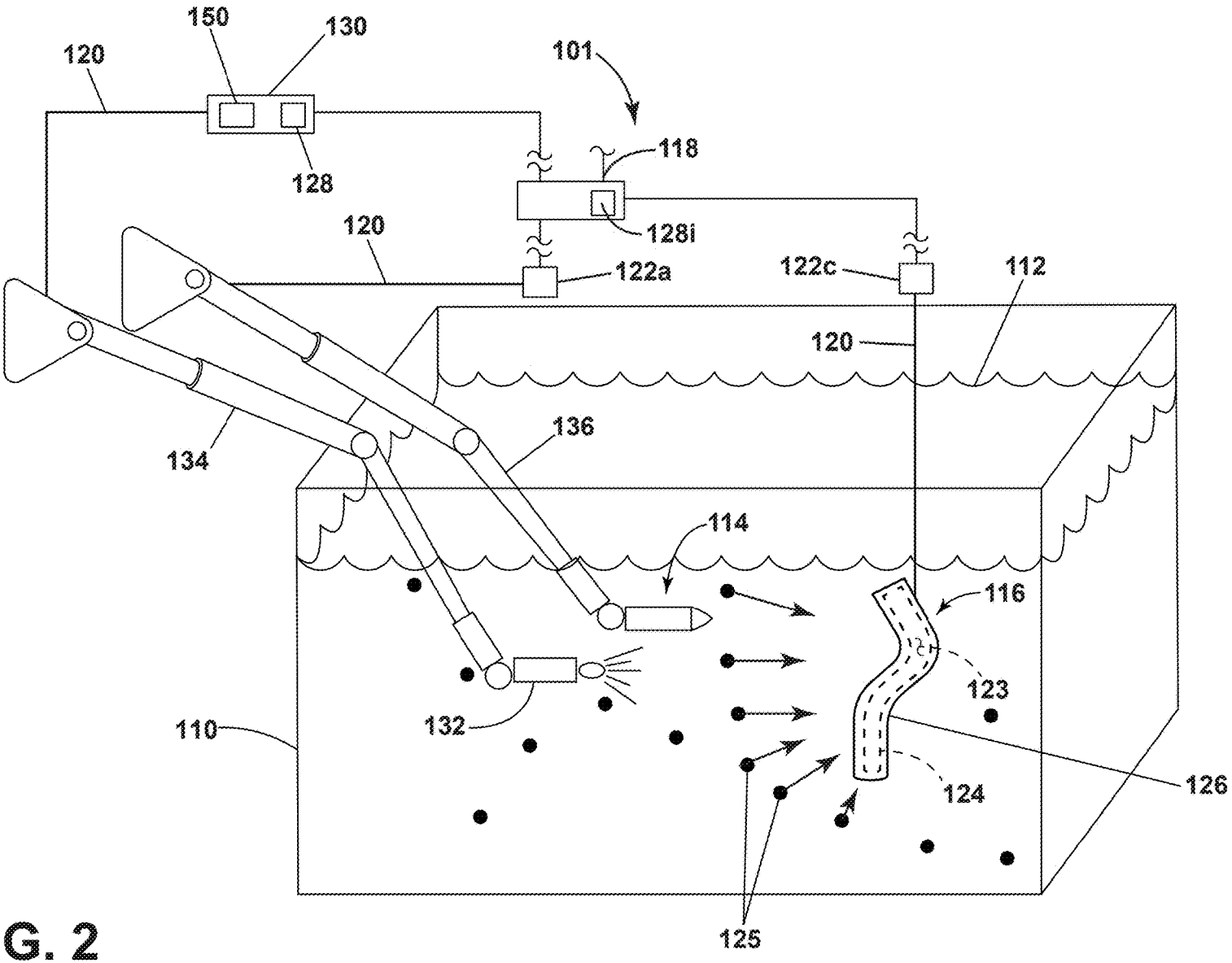
FIG. 2 is a schematic perspective view of a system for executing an electroforming process for forming an electroformed component in accordance with various aspects described herein.

Referring now to FIG. 2, a system 101 for executing an electroforming process is illustrated in accordance with various aspects described herein. The system 101 is similar to the system 1; therefore, like parts of the system 101 will be identified with like numerals increased by 100, with it being understood that the description of the like parts of the system 1 applies to the system 101, except where noted.

The system 101 includes an electroforming reservoir or tank 110, an anode 114, a cathode 116, a power source 118, electrical conduits 120, and switches 122*a*, 122*c*. An electrolytic solution 112 containing metal ions 125 can be provided in the tank 110.

The anode 114 and cathode 116 can be located within the tank 110 and submerged in the electrolytic solution 112. The anode 114 can be a sacrificial or non-sacrificial anode. The cathode 116 can be spaced from the anode 114 within the electrolytic solution 112. The cathode 116 can include a mandrel 124 having a coating surface 123. The mandrel 124 can be removable or non-removable from an electroformed component 126 formed by layering the metal ions 125 on the coating surface 123 of the mandrel 124.

The anode 114 and the cathode 116 can also be electrically coupled to the power source 118 by way of electrical conduits 120 as shown. An anode switch 122*a* can be provided between the anode 114 and power source 118. A cathode switch 122*c* can be provided between the anode 114 and power source 118. The power source 118 can be electrically coupled to a controller module 128 to control the flow of current through the electrical conduits 120. Additionally, or alternatively, an internal controller 128*i* can be provided within the power source 118 to control the anode and cathode switches 122*a*, 122*c*. The system can further include a computer 130 electrically coupled to or including the controller module 128.

The system 101 can also include a sensor 132 for scanning the electroformed component 126 during the electroforming process. The sensor 132 can be a piezoelectric sensor. It is further contemplated that the sensor 132 utilizes a pulse-echo technique, such that the speed of sound in the specimen and material enables a determination of a thickness of the electroformed component 126 by interrogating the thickness at fixed spacing. The sensor 132 can be immersed in the electrolytic solution 112. At least one robotic arm, illustrated as a first robotic arm 134, can be electrically coupled to the controller module 128 via the electrical conduits 120. The sensor 132 can be mounted to the first robotic arm 134 for movement of the sensor 132 within the electrolytic solution 112. A second robotic arm 136 can extend into the electrolytic solution 112. The anode 114 can be mounted to the second robotic arm 136. The second robotic arm 136 can be electrically coupled to the controller module 128 via the electrical conduits 120.

The computer 130 can include a module 150 with instructions for performing the electroforming process. The computer 130 can be in communication with the controller 128 to execute the module 150 as a closed-loop feedback module. The controller 128 can be in communication with the sensor 132, the anode 114, and the cathode 116. The controller 128 can be in communication with the sensor 132 via the electrical conduits 120 to the first robotic arm 134. The anode 114 can communicate with the controller 128 via the electrical conduits 120 to the second robotic arm 136 and to the anode switch 122*a*. The controller 128 can further communicate with the cathode 116 via the electrical conduits 120 to the cathode switch 122*c*. During operation, a current can be supplied from the anode 114 to the cathode 116 to cause the metal ions 125 to move toward and accumulate onto the cathode 116 (e.g., mandrel 124).

Figure 3:
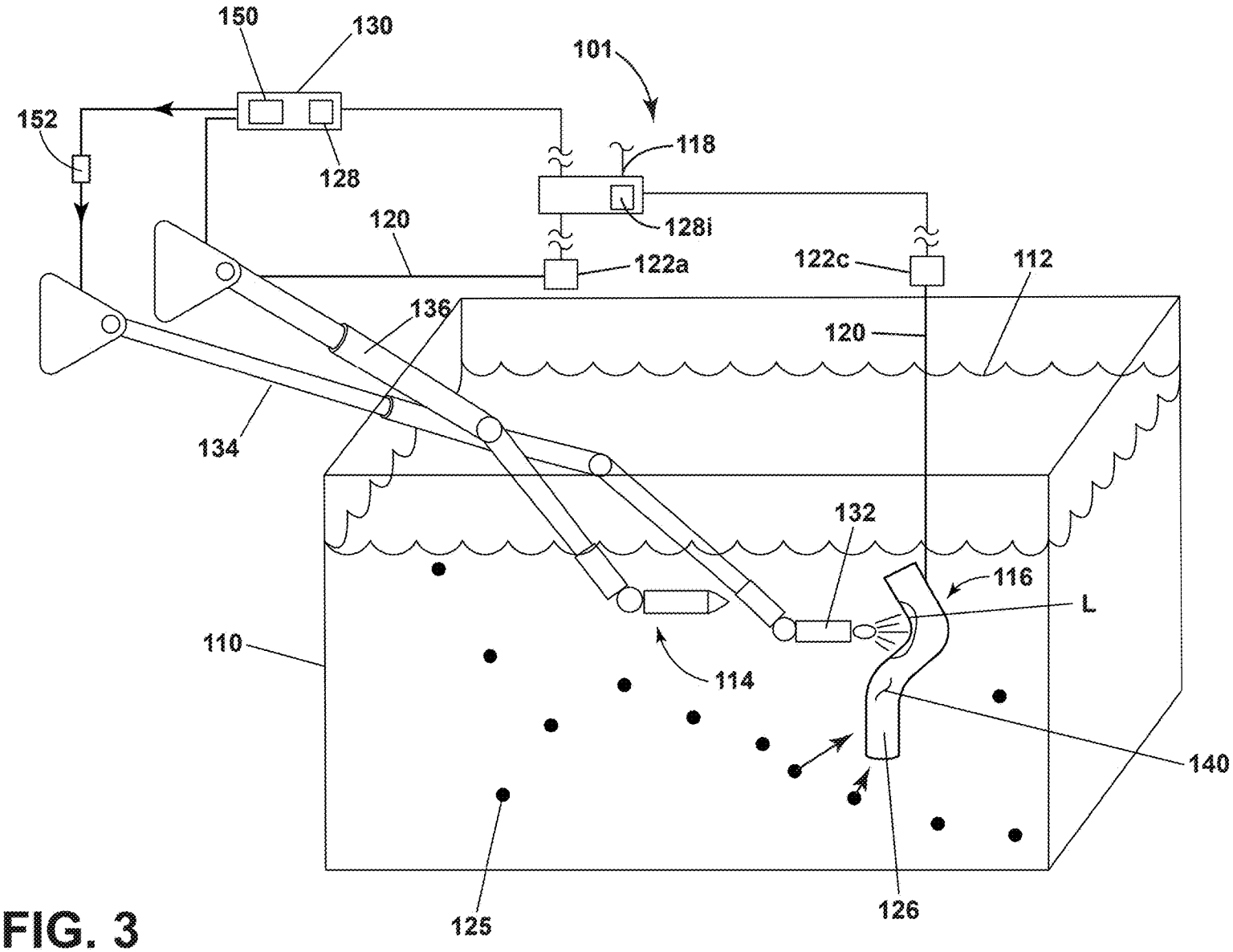
FIG. 3 is a schematic perspective view of the system from FIG. 2 during the electroforming process with a sensor positioned close to the electroformed component according to an aspect of the disclosure herein.

Turning to FIG. 3, the accumulation of metal ions 125 on the cathode 116 coats the cathode 116 to define a component surface 140 of the electroformed component 126. The module 150 includes instructions 152 to scan the component surface 140 with the sensor 132. The instructions 152 may include control instructions for the robot arm 134 to position and orient the sensor 132 with respect to a plurality of predetermined locations on a model of the component surface 140. For example, the first robotic arm 134 in turn moves the sensor 132 close to the cathode 116 for scanning the electroformed component 126 at a predetermined location (denoted "L"). The sensor 132 can be physically moved over the part, for each predetermined location L, to get coverage of the component surface 140.

Figure 4:
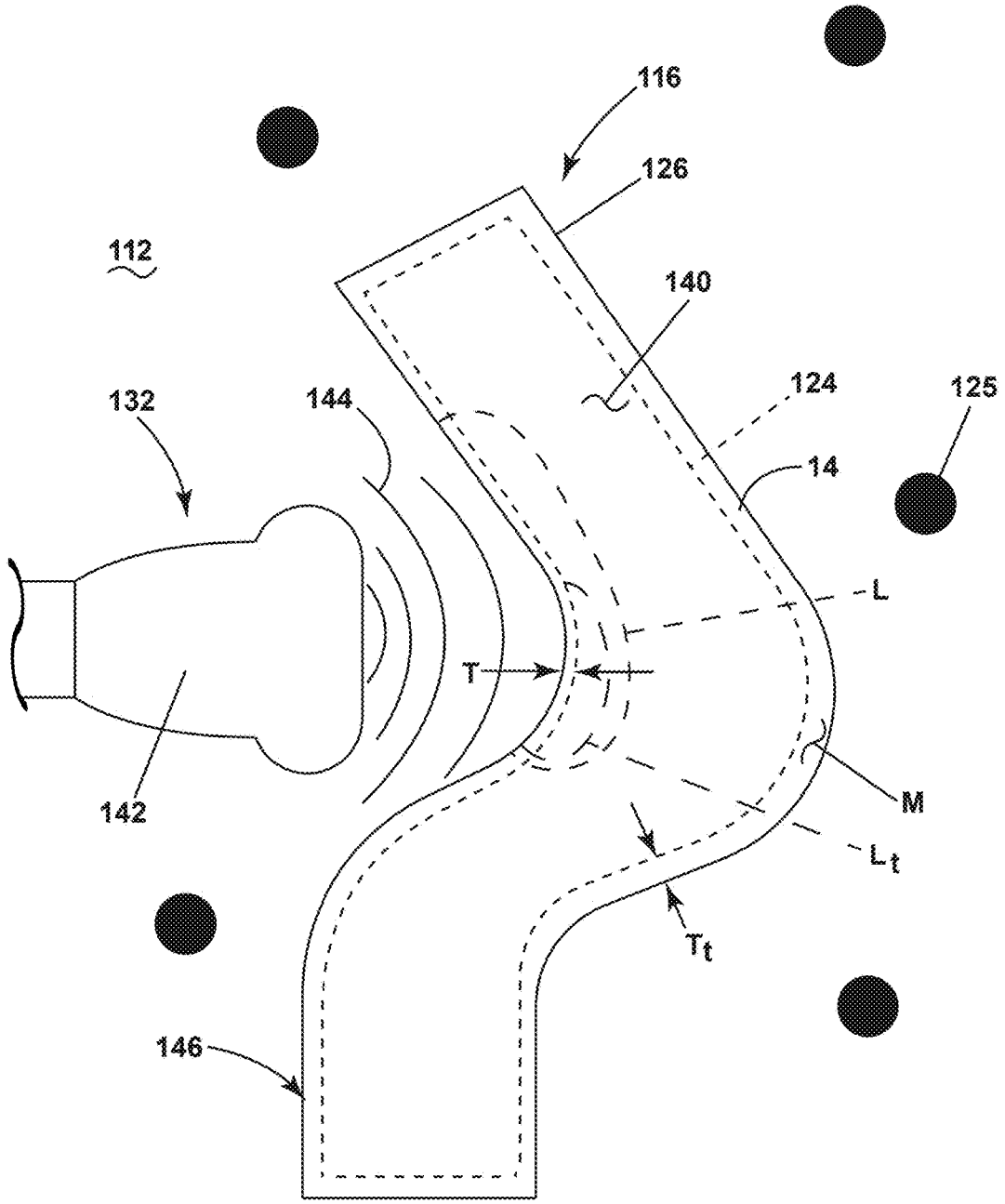
FIG. 4 is an enlarged schematic view of the electroformed component from FIG. 3 with a sensor according to an aspect of the disclosure herein.

Turning to FIG. 4, an enlarged view of the electroformed component 126 from FIG. 3 is illustrated. At least one metal layer 146, illustrated as a first metal layer 146*a*, can define the electroformed component 126. It should be understood that the at least one metal layer 146 can include a plurality of layers of metal (denoted "M"). In some examples, the mandrel 124 can be removed from the at least one metal layer 146, e.g., a sacrificial mandrel, to form the electroformed component 126. In some examples, the mandrel 124 can remain in place and at least partially define the electroformed component 126 with the at least one metal layer 146. The at least one metal layer 146 defining the electroformed component 126 has a thickness T (denoted "T"). A target thickness (denoted "Tt") can be between 0.5-10 mm, including between 0.5-5 mm, or between 1-5 mm, in non-limiting examples. The thickness T can be constant or varied at various predetermined locations L, of the electroformed component 126. It is contemplated that the at least one metal layer 146 forms a standalone, thick electroform, such as may be used for structural applications.

The sensor 132 can include an ultrasound transducer 142 where ultrasonic waves 144 provide feedback regarding the thickness T at the predetermined location L on the at least one metal layer 146 defining the component surface 140. When the thickness T at the predetermined location L is less than the target thickness (T<Tt), the predetermined location L can be identified as a target location (denoted "Lt"). In this manner, the electroforming process can utilize non-destructive testing (NDT).

Figure 5:
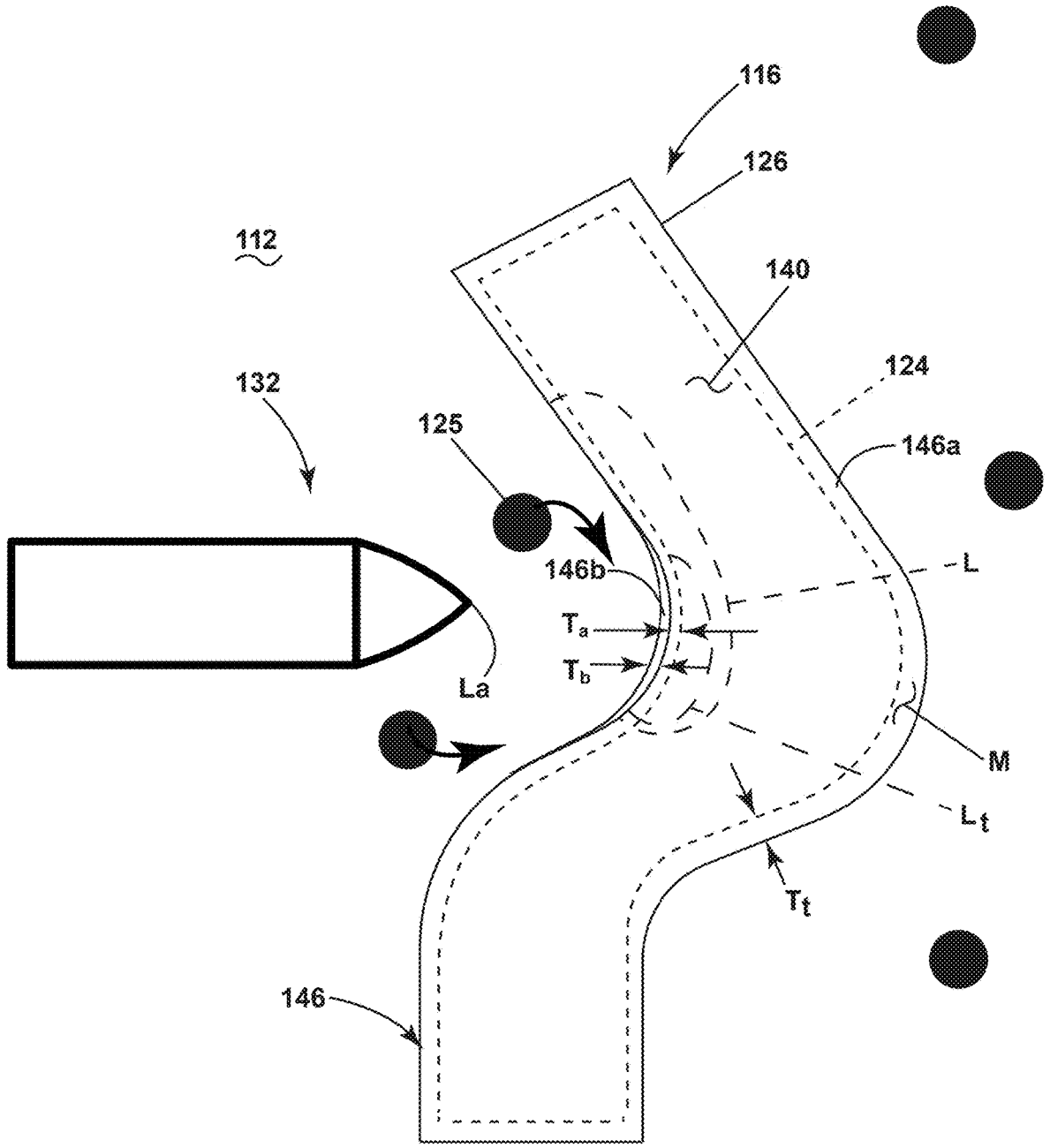
FIG. 5 is an enlarged schematic view of the electroformed component from FIG. 3 with an anode according to an aspect of the disclosure herein.

Turning to FIG. 5, an enlarged view of the electroformed component 126 is illustrated again with the anode 114. An anode location (denoted "La") can be determined from the target location Lt. Upon completion of scanning and determining the target locations Lt, the anode 114 can be moved to the anode location(s) La associated with the target location(s) Lt to add a second metal layer 146*b* onto the first metal layer 146*a* and thereby increase the thickness T at the target location Lt. In particular, a first thickness Ta of the first metal layer 146*a* and a second thickness Tb of the second metal layer 146*b* can together equal the target thickness Tt. The thickness T at the previously determined target locations Lt can be measured again as described above to determine if any predetermined locations L remain as target locations Lt and, if so, additional layers are added at the target locations Lt according to the method described herein.

Figure 6:
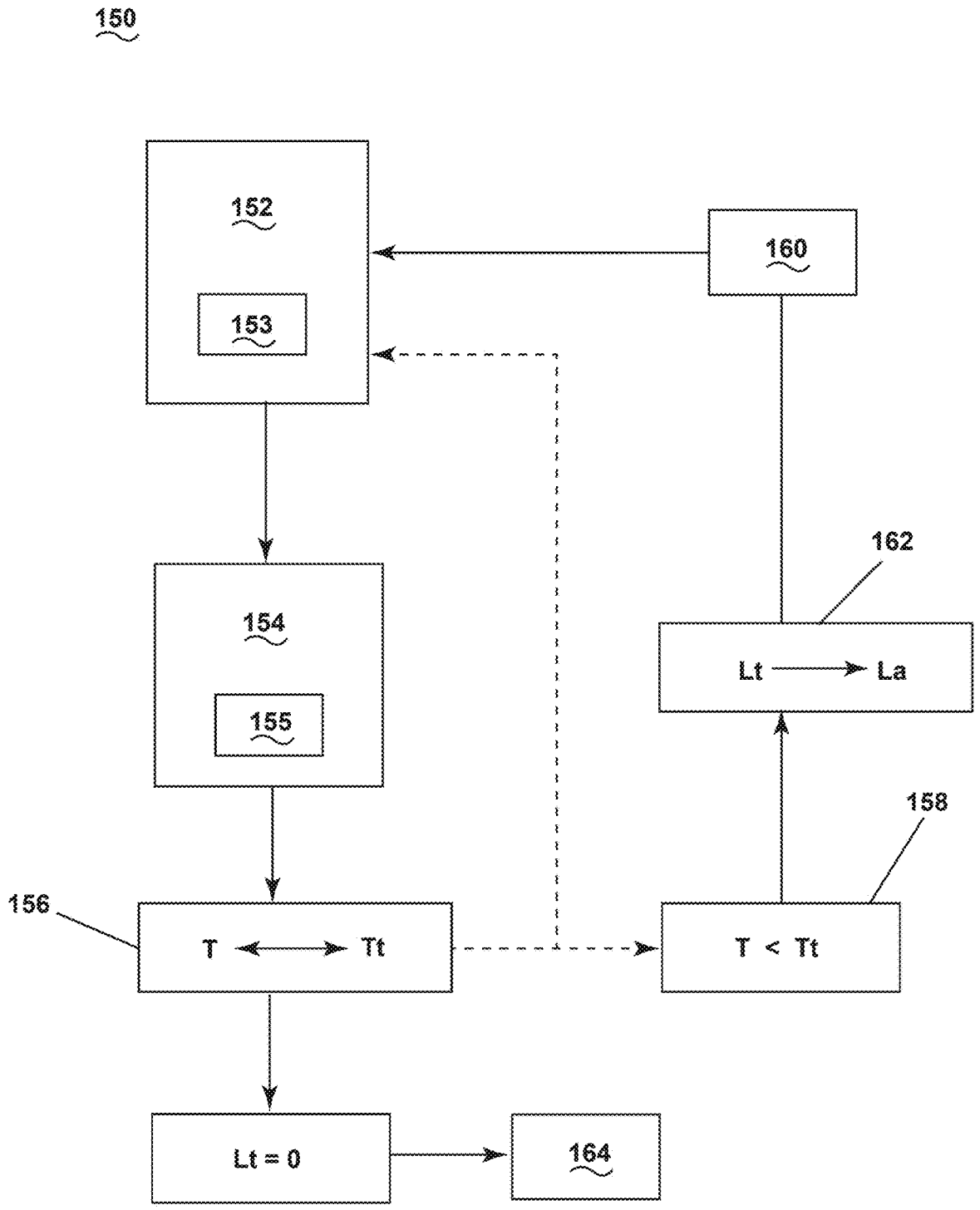
FIG. 6 is a flow chart illustrating a module for a computer to run during the electroforming process according to an aspect of the disclosure herein.

FIG. 6 is a flow chart illustrating the module 150 for running during the electroforming process described herein. The module 150 includes the instructions 152 to scan the first metal layer 146*a* of the electroformed component 126. Scanning generates a real-time data set 153 of measurements (e.g., ultrasound measurements) at the various predetermined locations L for the computer 130. Further, the module 150 includes instructions 154 to determine the thickness T of the at least one metal layer 146 from the real-time data set 153 with the computer to produce a thickness data set 155 at the various predetermined locations L.

Instructions 156 to compare the thickness T to the target thickness Tt are also included in the module 150. In particular, the module 150 includes instructions 158 to identify any predetermined location L where the thickness T, by way of non-limiting example the first thickness Ta, is less than the target thickness Tt at a target location Lt. In an event the target location Lt is present on the component surface 140, instructions 160 for converting the target location Lt to the anode location La within the electrolytic solution 112 are sent to the at least one robotic arm 134. Further, the module 150 includes instructions 162 to deposit additional metal M to define, by way of non-limiting example the second metal layer 146*b*, at the target location Lt with the anode 114. Further, the instructions 162 can include how much material to deposit to define the second metal layer 146*b*.

The module 150 provides feedback in real-time. This immediate feedback decreases the time to conduct the entire electroforming process. Upon completion and reaching the target thickness Tt for the entire electroformed component 126, the module 150 can include instructions 164 to terminate the electroforming process. In other words when zero target locations Lt exist, instructions 164 to terminate the electroforming process can be sent to the computer 130.

Figure 7:
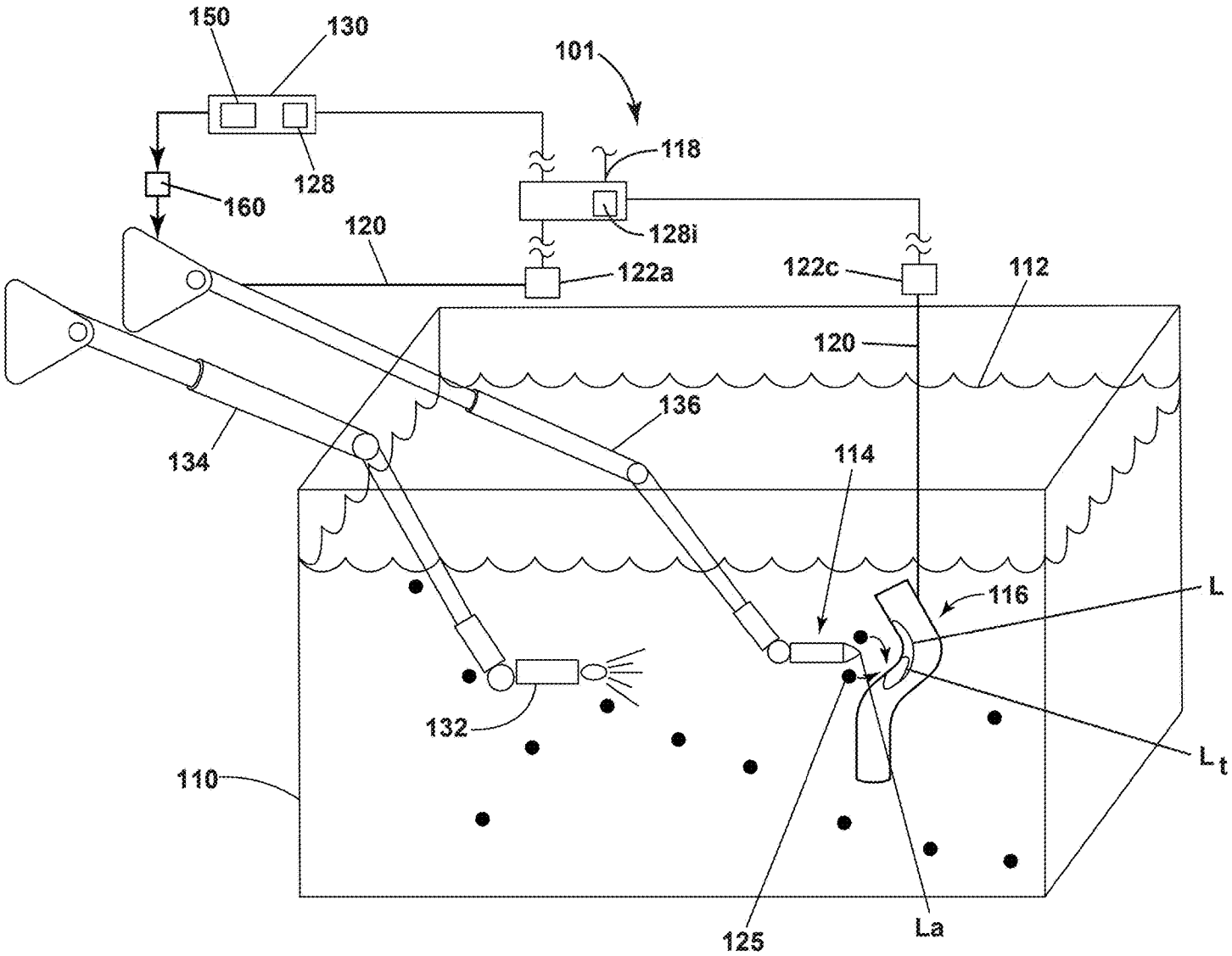
FIG. 7 is a schematic perspective view of the system from FIG. 2 during the electroforming process with an anode positioned close to the electroformed component according to an aspect of the disclosure herein.

FIG. 7 shows the system 101 again during the electroforming process. The instructions 160 to deposit additional metal layers 146 at the target location Lt have been communicated with the anode 114 from the computer 130. The second robotic arm 136 in turn moves the anode 114 close to the cathode 116 for depositing the additional metal layers 146 on the electroformed component 126 at the target location Lt.

Figure 8:
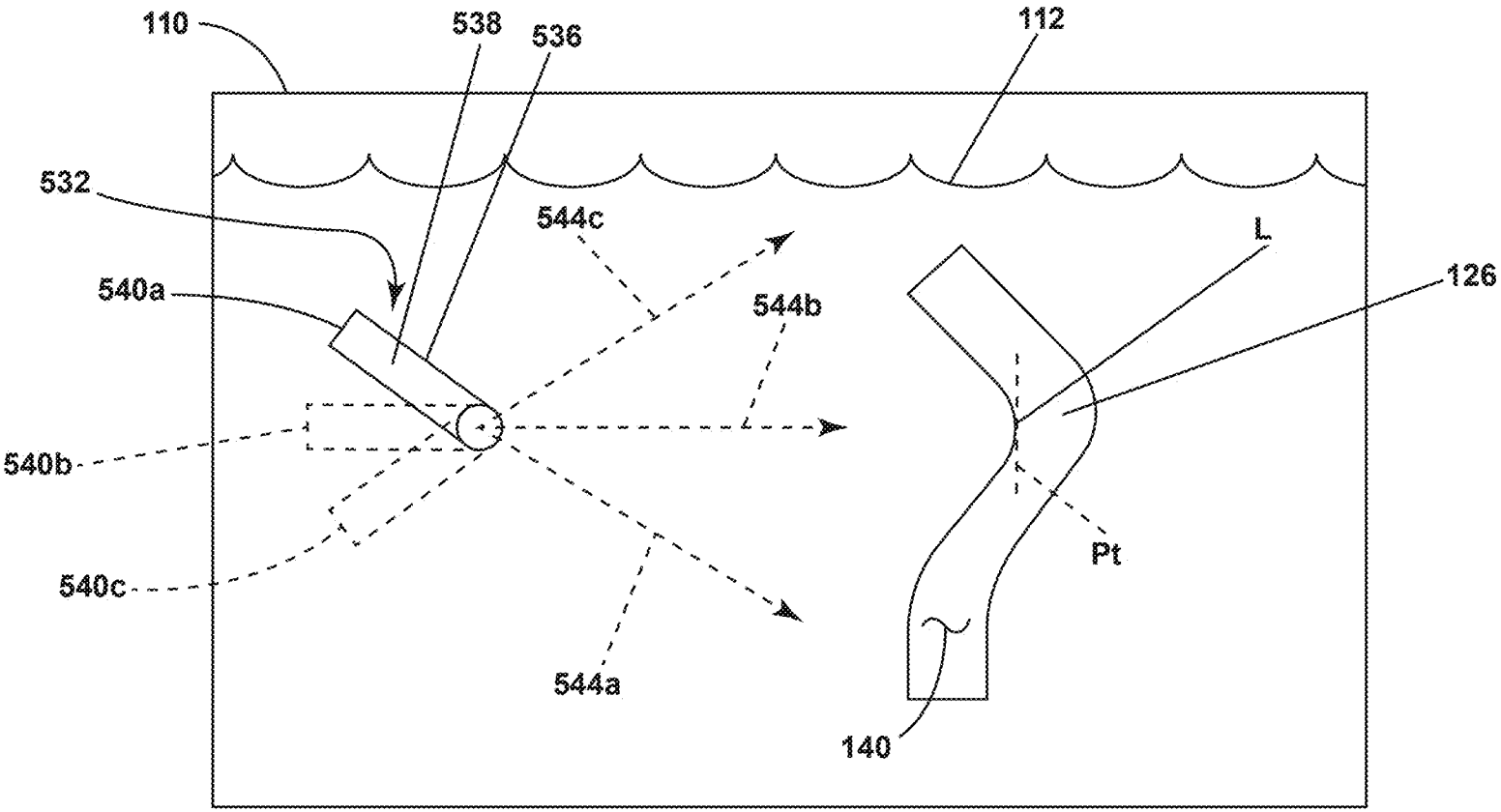
FIG. 8 is a simplified schematic of the system from FIG. 2 with a sensor according to another aspect of the disclosure herein.

FIG. 8 is simplified schematic of the system 101 with the tank 110, electrolytic solution 112, and electroformed component 126. A sensor 532 for the system 101, according to an aspect of the disclosure herein, is a single element sensor 536. The single element sensor 536 includes a body 538 movable between various positions and orientations, 540*a*, 540*b*, 540*c* for directing an ultrasonic wave 544. For example, ultrasonic waves 544*a*, 544*b*, 544*c* have different directions at the corresponding orientations 540*a*, 540*b*, 540*c*. In this manner, the sensor 532 can be oriented to provide the ultrasonic wave 544*b* perpendicular alignment with a plane (denoted "Pt") tangent to the component surface at the predetermined location L of the electroformed component 126.

Figure 9:
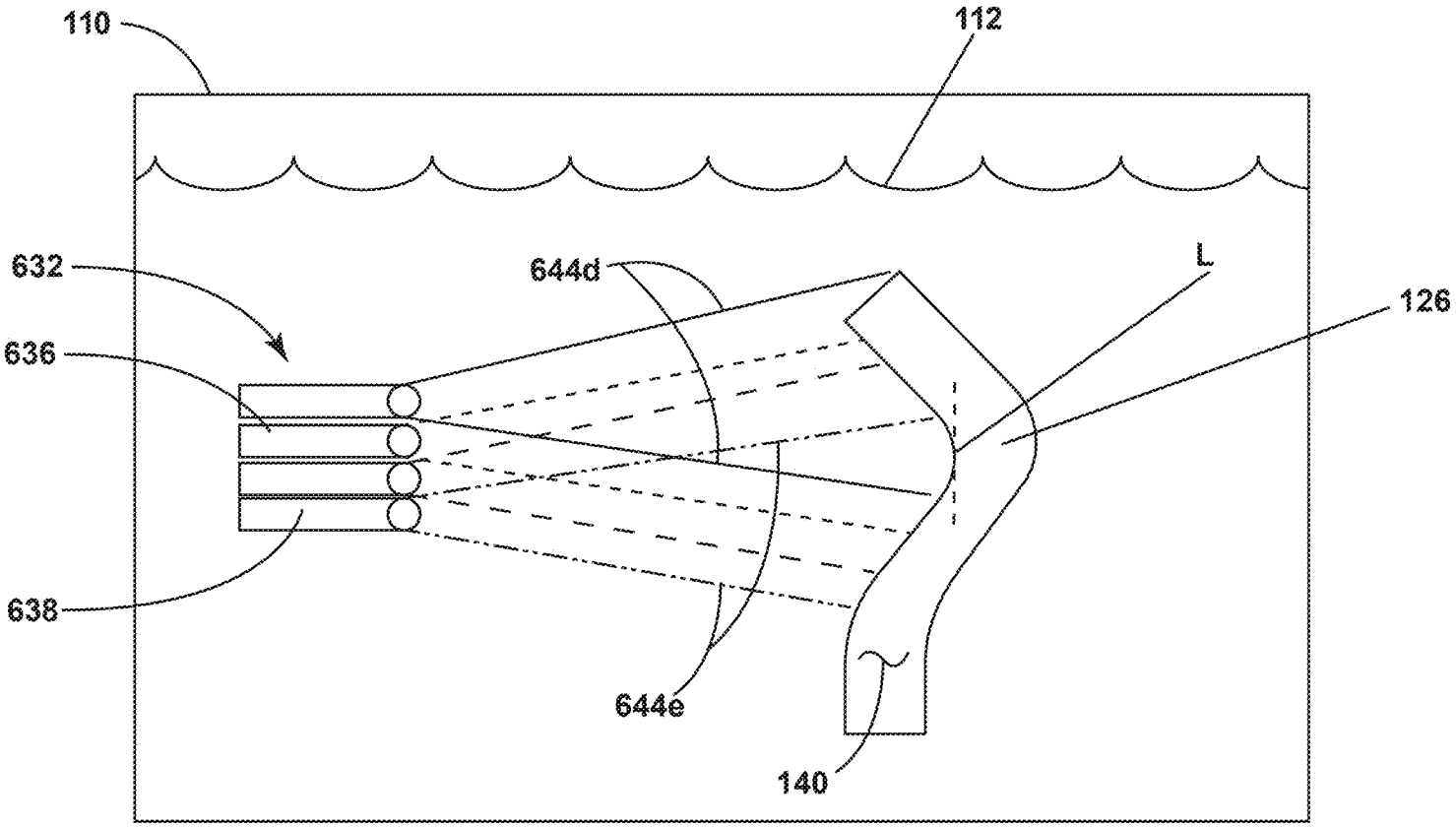
FIG. 9 is a simplified schematic of the system from FIG. 2 with a sensor according to yet another aspect of the disclosure herein.

FIG. 9 is simplified schematic of the system 101 with the tank 110, electrolytic solution 112, and electroformed component 126. A sensor 632 for the system 101, according to another aspect of the disclosure herein, is a phased array sensor 636. The phased array sensor 636 includes multiple stacked sensors 638 that can together direct, sweep, or electronically steer a beam or ultrasonic wave 644*d*, 644*e*. By way of non-limiting example ultrasonic wave 644*d* to the predetermined location L. The phased array sensor 636 enables scanning large areas of the electroformed component 126 without movement of the sensor 632.

Determining the correct direction, orientation, or steering direction with respect to a sensor location for implementing the scanning and depositing described herein can be accomplished in various ways. In one non-limiting example, the correct direction of ultrasonic waves 644*d*, 644*e* in FIG. 9. An initial expected part dimension, by way of non-limiting example the target thickness Tt, associated with the electroformed component 126 can be determined from a model or design, by way of non-limiting example from a CAD drawing. The at least one robotic arm 136 can be given instructions to begin at position where the CAD drawing indicates the sensor 132 and CAD drawing will be oriented at a perpendicular angle for scanning. In a real-world situation, perfectly normal or perpendicular orientation may not occur.

In this situation, tuning the sensor 132 to determine a normal orientation can be utilized. For example, with a pulse-echo technique, the directions of ultrasonic waves 544*b* can be varied. By way of non-limiting example, the sensor 132 can be moved slightly up and down, or side to side, or oriented at various angles. In another example, the ultrasonic waves 644*d* can be directed with the phased array sensor 636. The varying can continue until the amplitude of the echo signal received registers as a peak, or maxima signal. It should be understood that this maxima signal occurs when the direction or angle of the ultrasonic waves described herein are orthogonal to the plane Pt, as illustrated in FIG. 7. This tuning enables quick feedback in real time while implementing the module 150.

This tuning can be implemented with any of the sensors described herein as feedback including a signal increase then eventually decrease again indicates that the sensor has moved too far past the perpendicular position.

Figure 10:
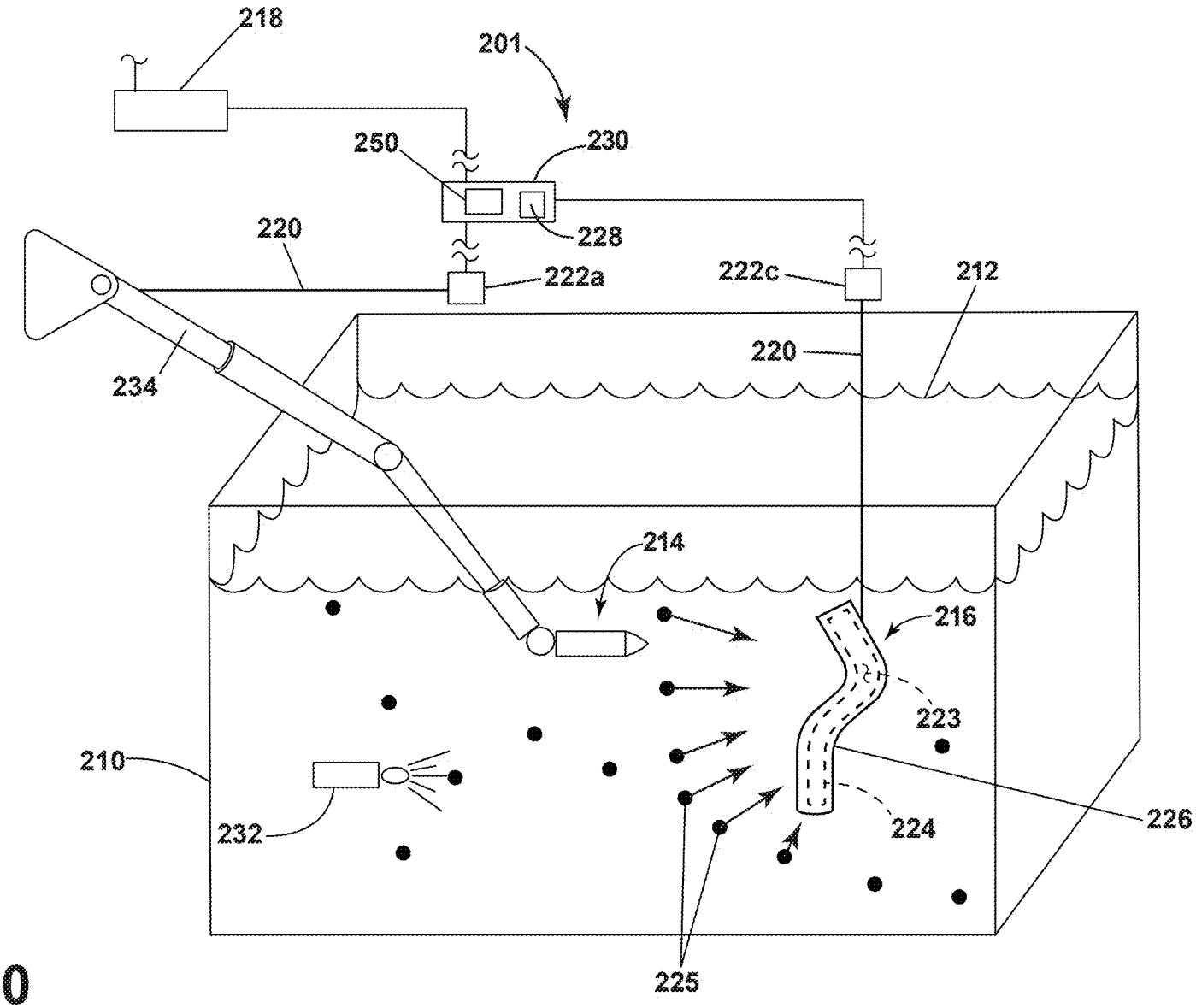
FIG. 10 is a schematic perspective view of a system for executing an electroforming process in accordance with another aspect of the disclosure herein where an anode is attached to a robotic arm and moveable within an electrolytic solution.

Referring now to FIG. 10, a system 201 for executing an electroforming process is illustrated in accordance with various aspects described herein. The system 201 is similar to the system 101; therefore, like parts of the system 201 will be identified with like numerals increased by 100, with it being understood that the description of the like parts of the system 101 applies to the system 201, except where noted.

The system 201 includes an electroforming reservoir an anode 214, a cathode 216, a power source 218, electrical conduits 220, and switches 222*a*, 222*c*. The anode 214 and cathode 216 can be located within a tank 210 and submerged in an electrolytic solution 212. The cathode 216 can include a mandrel 224 having a coating surface 223. The mandrel 224 can be removable or non-removable from an electroformed component 226 formed by layering metal ions 225 on the coating surface 223 of the mandrel 224.

The anode 214 and the cathode 216 can also be electrically coupled to a power source 218 by way of electrical conduits 220 as shown. An anode switch 222*a* can be provided between the anode 214 and the power source 218. A cathode switch 222*c* can be provided between the cathode 216 and the power source 218. The power source 218 can be electrically coupled to a controller module 228 to control the flow of current through the electrical conduits 220. The system 201 can further include a computer 230 electrically coupled to the power source 218 and including the controller module 228.

The system 201 can also include a sensor 232 for scanning the electroformed component 226 during the electroforming process. The sensor 232 can be immersed in the electrolytic solution 212.

A first robotic arm 234 can be electrically coupled to the controller module 228 via the electrical conduits 220. The anode 214 can be removably mounted to the first robotic arm 234 for movement of the anode 214 within the electrolytic solution 212.

Figure 11:
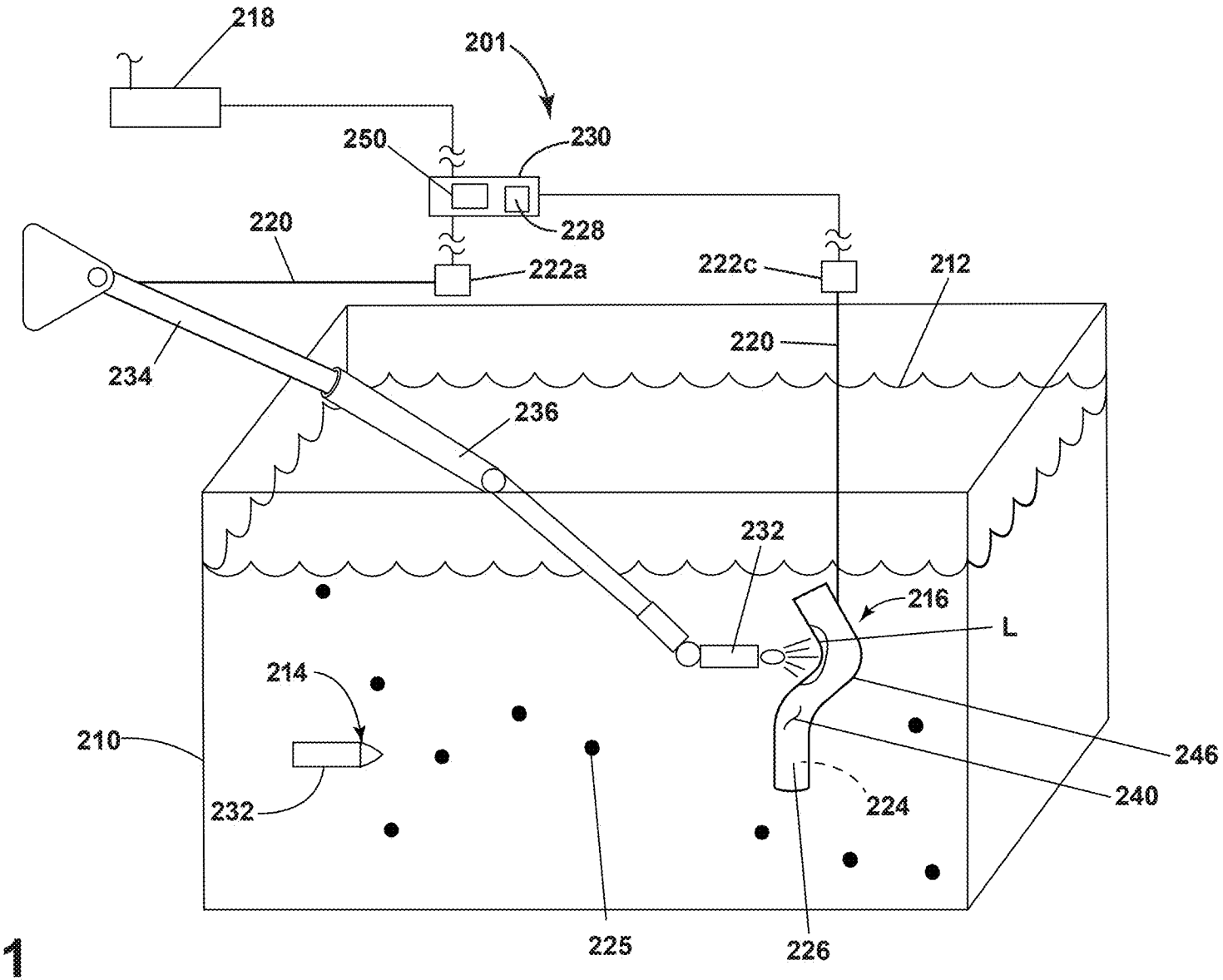
FIG. 11 is a schematic perspective view of the system from FIG. 10 where the anode is removed from the robotic arm and a sensor is attached to the robotic arm and moveable within the electrolytic solution.

Turning to FIG. 11, during the electroforming process, the anode 214 can be removed from the first robotic arm 234 and the sensor 232 can be attached to perform the scanning process as described herein.

Figure 12:
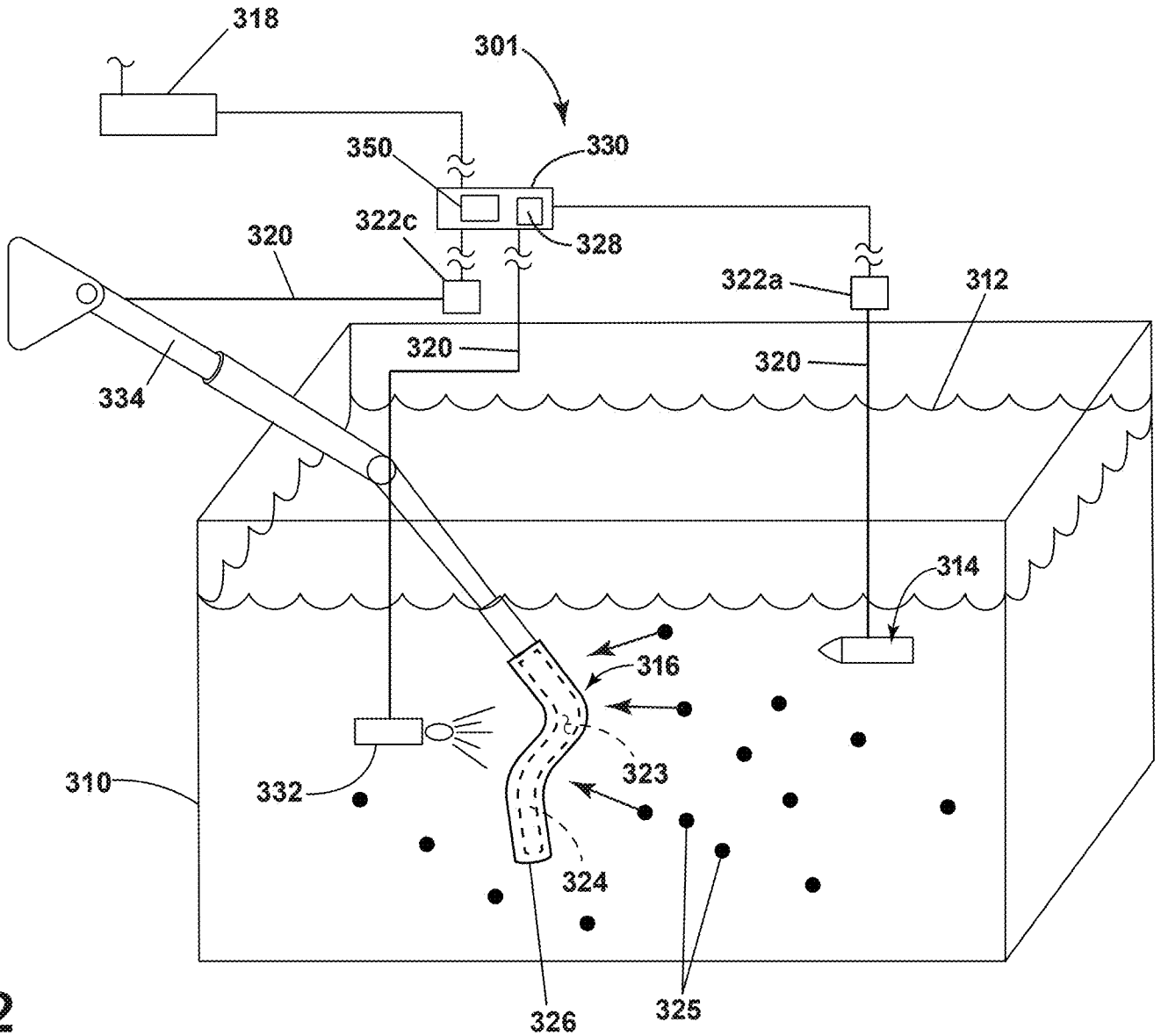
FIG. 12 is a schematic perspective view of a system for executing an electroforming process in accordance with yet another aspect of the disclosure herein where a cathode is attached to a robotic arm and moveable within an electrolytic solution.

Referring now to FIG. 12, a system 301 for executing an electroforming process is illustrated in accordance with various aspects described herein. The system 301 is similar to the system 201; therefore, like parts of the system 301 will be identified with like numerals increased by 100, with it being understood that the description of the like parts of the system 201 applies to the system 301, except where noted.

A cathode 316 can include a mandrel 324 having a coating surface 323. The mandrel 324 can be removable or non-removable from an electroformed component 326 formed by layering metal ions 325 on the coating surface 323 of the mandrel 324.

A first robotic arm 334 can be electrically coupled to a controller module 328 via electrical conduits 320. The cathode 316 can be mounted to the first robotic arm 334 for movement of the cathode 116 within an electrolytic solution 312. During the electroforming process, an anode 314 and a sensor 332 can remain stationary while the cathode is moved between them for scanning and electrodeposition as described herein.

Figure 13:
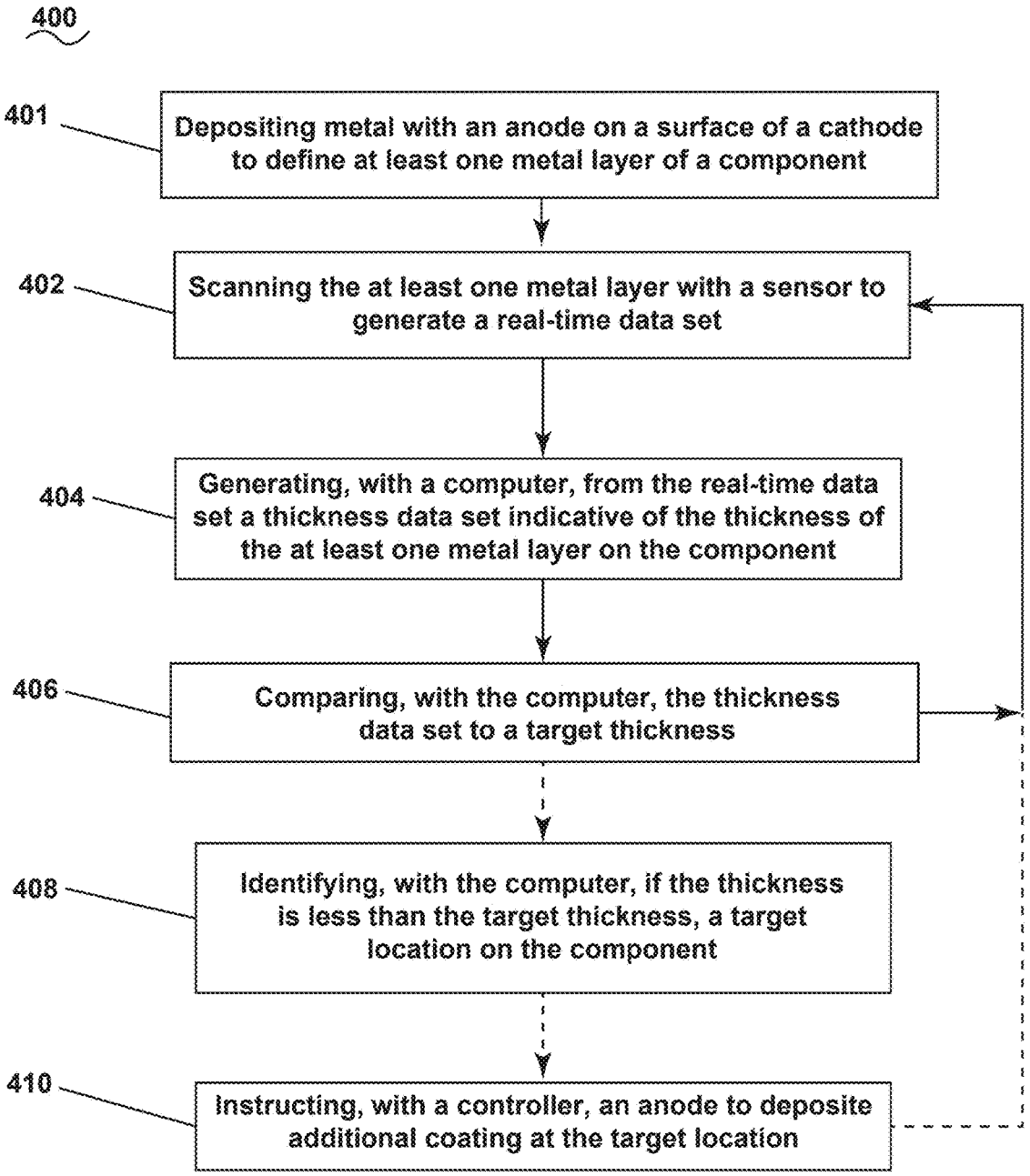
FIG. 13 is a flow chart illustrating a method of inspecting a thickness of the electroformed component according to an aspect of the disclosure herein.

FIG. 13 is a flow chart of a method 400 of electroforming a component. The method includes at block 401 depositing metal with the anode 114 on the coating surface 123 of the cathode 116 to define the at least one metal layer 146. The method includes at block 402 scanning the at least one metal layer 146 with the sensor 132 by transmitting and receiving ultrasonic waves with the sensor 132 to generate the real-time data set 153. At block 404 generating, with the computer 130, from the real-time data set 153, the thickness data set 155 indicative of the thickness T of the at least one metal layer 146 at the various predetermined locations L on the electroformed component 126. At block 406 comparing, with the computer 130, the thickness data set 155 to the target thickness Tt amount associated with each predetermined location L. It should be understood that the target thickness Tt can vary along an entirety of the electroformed component 126. At 408, identifying, with the computer 130, target locations Lt on the electroformed component 126 where the thickness T is less than the target thickness Tt. It should be understood that target location Lt are only identified in the event the thickness T is less than the target thickness Tt. In an event where the thickness T is less than the target thickness Tt, at 410, instructing, with the controller 128, the anode 114 to deposit additional metal at the target locations Lt to define the second metal layer 146*b*.

The method 400 can occur during the electroforming process as described herein. Any combination of features regarding the sensors 132, 232, 332, 532, 632 described herein is contemplated. By way of non-limiting example having an ultrasound transducer 142, utilizing a single element sensor 236, or featuring the phased array sensor 336 is contemplated. Further, the sensor 132 can be used for non-destructive testing (NDT).

The method 400 can further include immersing the sensor 132 in the electrolytic solution 112. Additionally, mobilizing the anode 114 with, by way of non-limiting example the second robotic arm 136, to move within the electrolytic solution 112 to the targeted locations Lt, is also contemplated as part of the method 400. Further, the anode 214 and the sensor 232 can be removably attached to a single first robotic arm 234 to complete the method 400. It is further contemplated that the cathode 316 is mobilized by a first robotic arm 334 while the anode 314 and sensor 332 remain stationary to complete the method 400.

The method 400 can further include repeating the generating, the comparing, the identifying, and the instructing as part of the module 150. Upon reaching the target thickness Tt, the method 400 can include terminating the electroforming process. It should be understood that several ways of scanning with one or more of the sensors described herein is contemplated.

Aspects of the present disclosure provide for a variety of benefits. When compared to known practices, the system and the method described herein enable an in-situ direct measurement and monitoring of the coating thickness deposition of electroforming process in the real-time. The sensors described herein provide sensing technology capable of targeting accurate thickness deposition. Furthermore, the sensors have immersion capability so that sensors can measure the coating thickness deposition amount in the electrotype environment.

The module enables the controller to receive sensor feedback and in turn adjust the measurement and monitoring strategy in real-time. Providing sensors on a first robotic arm enable measured protocols for mandrels with complex geometry. The second robotic arm of the anode further enables compensation for the difference between the target thickness and the measured thickness at specific locations. This in turn provides for a more precise and accurate electroforming process. Furthermore, the system and method described herein reduces or even eliminates incorrect fabrication thickness and in turn the fabrication of unwanted components.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are defined by the following clauses:

A system for electroforming a component, comprising an electroforming reservoir containing an electrolytic solution, an anode, and a cathode; a mandrel located within the electroforming reservoir and electrically connected to the cathode, and the mandrel having a coating surface on which metal is deposited to define at least one metal layer; a sensor for scanning the at least one metal layer; a computer in communication with the sensor, the anode, and the cathode, the computer comprising: a module comprising instructions to scan a first metal layer of the component with the sensor at a predetermined location, determine a thickness of the first metal layer at the predetermined location, compare the thickness to a target thickness, identify the predetermined location as a target location if the thickness is less than the target thickness; and deposit a second metal layer at the target location with the anode.

The system of claim 1, wherein at least one of the sensor, the anode, or the cathode is coupled to at least one robotic arm in communication with the computer.

The system of any preceding clause, wherein the module further comprises instructions to control the at least one robotic arm to move at least one of the sensor, the anode, or the cathode based on the target location and to deposit the second metal layer on the first metal layer at the target location.

The system any preceding clause, wherein the sensor is coupled to a first robotic arm and the anode is coupled to a second robotic arm.

The system any preceding clause, wherein the cathode is coupled to the at least one robotic arm.

The system of any preceding clause, wherein the sensor includes an ultrasound transducer.

The system of any preceding clause, wherein the sensor transmits and receives an ultrasonic wave when scanning.

The system of any preceding clause, wherein the sensor is immersed in the electrolytic solution.

The system of any preceding clause, wherein the sensor is movable for perpendicular alignment with the at least one metal layer.

The system of any preceding clause, wherein the sensor is one of a single element sensor or a phased array sensor.

The system of any preceding clause, wherein the module runs during an electroforming process of the component.

The system of any preceding clause, wherein the module further comprises instructions to terminate electroforming when the target thickness has been met.

A method of electroforming a component depositing metal with an anode on a surface of a cathode to define at least one metal layer of the component; scanning the at least one metal layer by transmitting and receiving ultrasonic waves with a sensor at a predetermined location to generate a real-time data set; generating, with a computer, from the real-time data set a thickness data set indicative of an amount of thickness of the at least one metal layer on the component; comparing, with the computer, the thickness data set to a target thickness; identifying, with the computer, if the amount of thickness is less than the target thickness, a target location on the component; and instructing, with a controller, the anode to deposit additional metal at the target location.

The method of any preceding clause, further comprising terminating the depositing when the target thickness is met.

The method of any preceding clause, further comprising repeating the scanning, the generating, the comparing, the identifying, and the instructing as part of a module.

The method of any preceding clause, further comprising immersing the sensor in an electrolytic solution.

The method of any preceding clause, further comprising controlling at least one robotic arm to move at least one of the sensor, the anode, or the cathode based on the target location.

The method of any preceding clause, further comprising controlling a first robotic arm to move at least one of the sensor or the anode based on the target location and controlling a second robotic arm to move the other of the sensor or the anode based on the target location.

The method of any preceding clause, further comprising exchanging one of the anode or the sensor with the other of the anode or the sensor to attach the other of the anode or the sensor to the first robotic arm.

The method of any preceding clause, further comprising mobilizing the cathode with the at least one robotic arm to move within the electrolytic solution between the anode and the sensor.

What is claimed is:

1. A system for electroforming a desired component, comprising:

an electroforming reservoir containing an electrolytic solution, an anode, and a cathode;

a mandrel located within the electroforming reservoir and electrically connected to the cathode, and the mandrel having a coating surface on which metal is deposited to define a component;

a first robotic arm moveable within the electroforming reservoir and having a sensor for scanning the component; and a computer in communication with the sensor, the anode, and the cathode, the computer comprising:

a module comprising instructions defining a plurality of predetermined locations of the desired component, the module configured to:

A) electroform a first metal layer of the desired component,

B) without removing the desired component from the electroforming reservoir, position the first robotic arm with respect to a first of the plurality of predetermined locations, defining a first predetermined location, C) scan the first metal layer of the desired component with the sensor at the first predetermined location, D) determine a thickness of the first metal layer at the first predetermined location based on the scan, E) compare the determined thickness to a first target thickness, F) identify the first predetermined location as a target location if the thickness is less than the first target thickness; and G) deposit a second metal layer at the target location with the anode.

2. The system of claim 1, wherein the sensor is immersed in the electrolytic solution.

3. The system of claim 1, the module further configured to:

H) repeat steps B)-G) for each of the plurality of predetermined locations.

4. The system of claim 1, wherein the first target thickness at the first predetermined location is different from a second target thickness at a second of the plurality of predetermined locations.

5. The system of claim 1, the module further configured to:

H) repeat steps B)-G) until the comparison at step E) determines that the determined thickness at the first predetermined location reaches the target thickness.

6. The system of claim 5, the module further configured to:

I) repeat steps B)-H) for each of the plurality of predetermined locations.

7. The system of claim 1, wherein the anode is coupled to a second robotic arm.

8. The system of claim 7, wherein the second robotic arm is configured to position the anode proximate to the first predetermined location to deposit the second metal layer only at the target location in step G).

9. The system of claim 1, wherein the sensor includes an ultrasound transducer.

10. The system of claim 9, wherein the sensor transmits and receives an ultrasonic wave when scanning.

11. The system of claim 1, wherein the sensor is movable for perpendicular alignment with the first metal layer.

12. The system of claim 11, wherein the sensor is one of a single element sensor or a phased array sensor.

* * * * *